US006026919A

United States Patent [19]

Thigpen et al.

[11] Patent Number: 6,026,919

[45] Date of Patent: Feb. 22, 2000

[54] CUTTING ELEMENT WITH STRESS REDUCTION

[75] Inventors: Gary Michael Thigpen, Houston; Coy M. Fielder, Cypress; Brad Weston, Houston, all of Tex.

[73] Assignee: Diamond Products International Inc., Houston, Tex.

[21] Appl. No.: 09/129,179

[22] Filed: Apr. 16, 1998

[51] Int. Cl.[7] ..... E21B 10/12

[52] U.S. Cl. ..... 175/432; 175/428

[58] Field of Search ..... 175/432, 431, 175/430, 428

[56] References Cited

U.S. PATENT DOCUMENTS 4,478,298 10/1984 Hake et al. .
4,592,433 6/1986 Dennis .
4,629,373 12/1986 Hall .
4,784,023 11/1988 Dennis .
4,972,637 11/1990 Dyer .
4,984,642 1/1991 Renard et al. .
5,011,515 4/1991 Frushour .
5,120,327 6/1992 Dennis .
5,379,853 1/1995 Lockwood et al. .
5,435,403 7/1995 Tibbitts .
5,469,927 11/1995 Griffin .
5,474,143 12/1995 Majkovic .

*Primary Examiner*—William Neuder
*Assistant Examiner*—Zakiya Walker
*Attorney, Agent, or Firm*—Sankey & Luck, L.L.P.

[57] ABSTRACT

An improved disc-shaped cutting element including first and second major flat surfaces and a cutting edge, said element comprised of a hard metal substrate defining an irregular interface bonded to a polycrystalline diamond, where said interface includes a plurality of concentric and redial grooves adapted to receive corresponding protrusions formed on the diamond layer so as to enhance wear like and impact resistance.

33 Claims, 5 Drawing Sheets

CUTTING ELEMENT WITH STRESS REDUCTION

BACKGROUND OF THE INVENTION

1. Field of the Invention

The present invention generally relates to abrasive cutters useful in creating subterranean boreholes. More specifically, the present invention is directed to a compact cutter having superior impact resistance by having reduced residual stress.

2. Description of the Prior Art

Polycrystalline diamond compacts (PDC) are commonly used in oil field drilling and machine tools. A PDC is a synthetic form of diamond that is made by pressing diamond powder and cobalt onto a cemented tungsten carbide substrate. In the press, the cobalt becomes liquid and acts as a catalyst for diamond grain growth. The result is a highly abrasive, e.g. roughly 90% as abrasive as natural diamond, and environmentally resistant component which is very adaptable to drilling systems for resistant rock formations.

Although PDC is resistant to abrasion and erosion, a PDC compact cutter demonstrates several disadvantages. The main components of the PDC system, diamond and tungsten carbide, are brittle materials subject to impact fracturing. Moreover, because tungsten carbide and diamond have different coefficients of thermal expansion, there are residual stresses in a PDC system because the tungsten carbide demonstrates greater contraction during the cooling phase than that of the synthetic diamond.

As a result of the aforereferenced disadvantages, attempts have been made in the art to limit the affects by modifying the geometry at the interface between the diamond and the tungsten carbide. Such modifications have usually taken the place of an irregular, non planar interface geometry. The most beneficial resultant of the non-planar interface, defined as any design where the interface between the diamond and tungsten carbide is not a circular plane, is the redistribution of residual stresses. Redistributing residual stresses allow the PDC manufacturer to increase the diamond thickness, thereby providing increased wear resistance. An irregular interface is advantageous since brittle materials are more resistant to compressive loads than tensile loads. The existence of a flat interface causes tensile stress plane between the diamond and tungsten carbide. This plane generally defines a main failure locus for delamination of the diamond layer.

One cutter which first utilized a non-planar interface geometry was the "Claw" cutter, so named as a result of the wear pattern of a worn cutter which looked like the remnants of claw marks. The interface of the "Claw" cutter, when viewed in cross section, consists of a plurality of parallel ridges and grooves disposed across the diameter. The "Claw" cutter provided advantages in the areas of wear resistance, but demonstrated a number of disadvantages which included the need to orient the cutter in order to position the parallel diamond inserts normal to the cutting surface. This required orientation of the cutter vis-a-vis the drill bit body complicates the manufacture process.

The so called "Ring Claw" cutter adopted a similar design to that of the Claw cutter except that the Ring Claw included a enhanced thickness ring of synthetic diamond which bounded a series of parallel inserts which also includes diamond of an enhanced thickness. The Ring Claw cutter demonstrated improved wear resistance over the Claw cutter, but when the outer diamond ring became worn, demonstrated similar disadvantages as to the need for precise orientation vis-a-vis the work surface.

Another prior art cutter is colloquially known as the "target cutter", and is characterized by an alternating grooves and ridges formed on the cutting face in the form of a target. The target cutter, while addressing the issue of orientation presented by the "Ring Claw cutter," demonstrated vulnerability to hoop stresses. Hoop stresses are created on the bounding ridges of tungsten carbide positioned interior to grooves filled with synthetic diamond. Hoop stresses are caused by uninterrupted concentric grooves and ridges in the PDC. During cooling of the PDC after pressing, the tungsten carbide ridges will contract and compress on the synthetic diamond rings disposed in the internal grooves. Such contraction simultaneously pulls the tungsten carbide substrate away from diamond disposed in external rings. These differential stresses create a tensile load between all of the internal tungsten carbide ridges and synthetic diamond disposed in all external grooves. Such stresses can be severe enough to completely delaminate the synthetic diamond layer. A more common failure is the creation of stress zone in the interface, where friction due to impact can originate.

SUMMARY OF THE INVENTION

The present invention addresses the above and other disadvantages of prior cutter designs by providing a tool insert comprising a disc-shaped abrasive compact having major flat surfaces on each of opposite sides thereof, at least a part of the periphery of the margin flat surfaces providing a cutting edge.

In a preferred embodiment, the insert is comprised of a hard metal substrate bonded to abrasive compact material, e.g synthetic diamond, where the substrate defines an alternating set of at least partially interlocking ridges and grooves radially and concentrically organized about the plane defined by the major flat surface, where said ridges extend into the abrasive material and where said abrasive material extends into said grooves to form an interlocking interface.

The present invention offers a number of advantages over the prior art. One such advantage is a reduction in residual stress zones as a result of the interlocking radial and. concentric grooves and ridges. These radial ridges and grooves serve to interrupt hoop stresses which traditionally consist of fractures propagated circumferentially through the interface, many times sheering the abrasive material from the substrate.

The present invention also serves to minimize failures occasioned as a result of differential expansion coefficients between the abrasive material and the underlying substrate during the cooling phase.

Further, the cutter of the present invention facilitates drill bit manufacture since the cutter can be oriented at any angle on the drill bit body during assembly.

The cutter also presents a uniform thickness of abrasive material around the circumference of the cutter with relative radial symmetry.

DETAILED DESCRIPTION OF THE PREFERRED EMBODIMENTS

Figure 1:
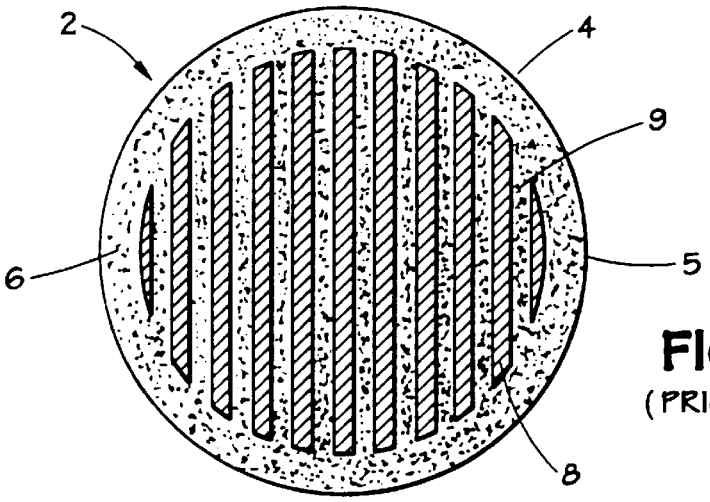
FIG. 1 (PRIOR ART)
FIG. 1 is a top, cross sectional view of a prior art, "ring-claw" cutter.
Figure 2:
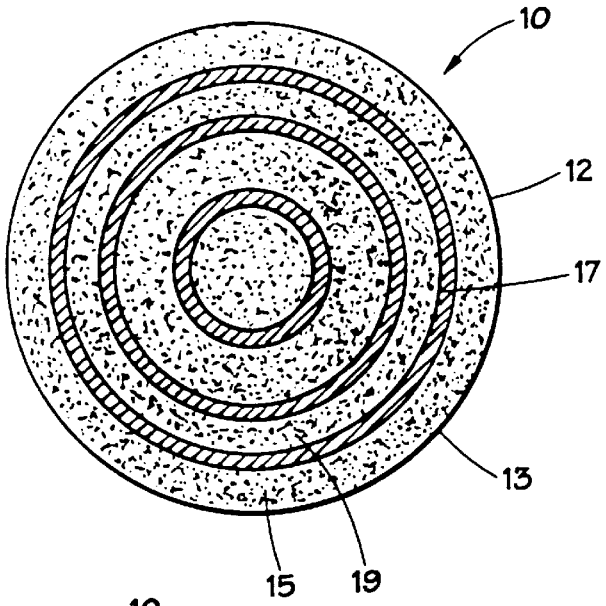
FIG. 2 (PRIOR ART)
FIG. 2 is a top, cross sectional view of a prior art, "target" cutter.

FIGS. 1 and 2 illustrate top, cross-sectional views of prior art cutters sold, in the instance of FIG. 1, under the name "ring claw cutter" and in the instance of FIG. 2, under the name "target cutter".

By reference to FIG. 1, the "ring claw" cutter 2 comprises a disc shaped body 4 defining a peripheral cutting edge 5 bounding a top, cutting surface 6 comprised of a superabrasive material, commonly polycrystalline diamond. As illustrated, the polycrystalline cutting surface 6 is bonded to an underlying hard metal substrate, e.g. cemented tungsten carbide, defining a series of axial ridges 8 bounded by grooves 9 about which the superabrasive is formed and subsequently bonded. The "ring claw" cutter is characterized by a radial groove formed at the outer periphery of body 4, which groove receives the polycrystalline diamond to form cutting edge 5, as shown.

FIG. 2 illustrates the prior art "target cutter" 10 which also includes a disc shaped body 12 defining a peripheral cutting edge 13 bounding a top cutting surface 15 again comprised of a polycrystalline diamond. In this prior embodiment, the carbide substrate forms a series of concentric ridges 17 defining complementary grooves 19 in which the polycrystalline diamond is formed and subsequently bonded.

Figure 3:
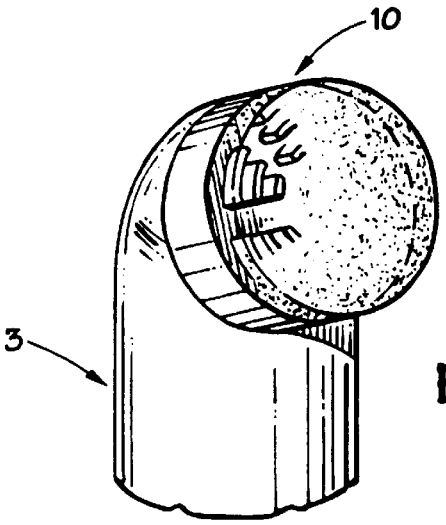
FIG. 3 is a perspective view of a stud cutter which may be affixed to a drill bit.

Both the "ring claw" and "target cutter" are typically bonded to a cemented carbide cutter to form a stud cutter. A perspective view of a stud cutter 3 as used with the "target cutter" 10 is illustrated in FIG. 3. In use, the stud cutter 3 is mounted in a drill bit in a known manner so that the cutting edge 13 is exposed and available to contact the surface to be drilled.

The "target" cutter embodiment suffers from problems of hoop stresses caused as a result of differential coefficients of expansion exhibited during cooling. These hoop stresses, in some cases, are severe enough as to result in delamination of the polycrystalline diamond layer. The "ring claw" cutter also requires orientation of axial ridges 8 prior to the cutter being mounted on the drill bit (not shown).

Figure 4:
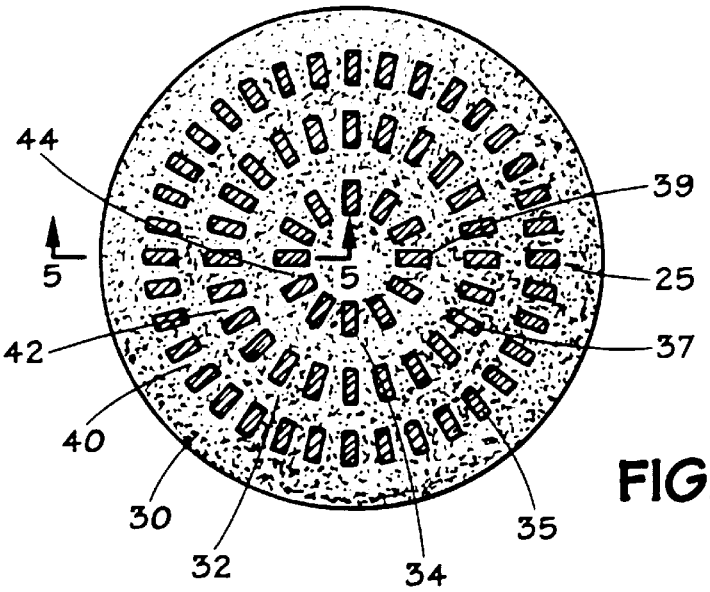
FIG. 4 is a top, cross-sectional view of one embodiment of the cutter of the present invention.
Figure 5:
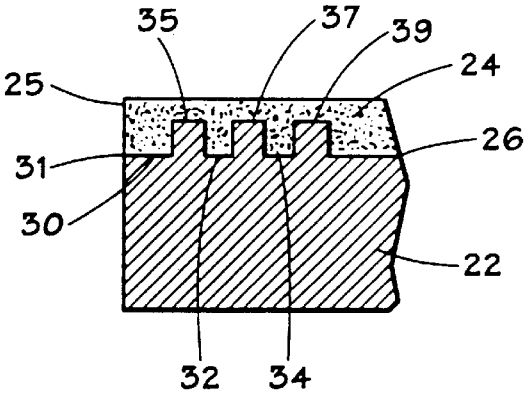
FIG. 5 is a side, cross-sectional view of the embodiment illustrated in FIG. 4.
Figure 6:
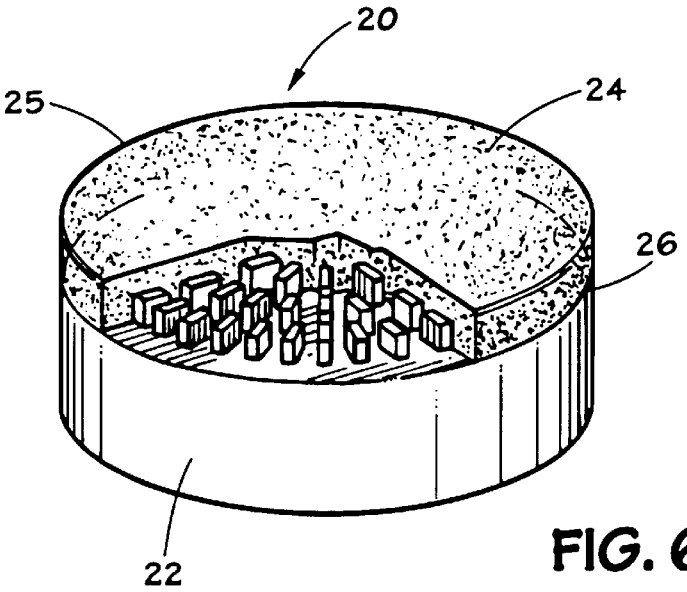
FIG. 6 is a perspective, cut-away view of the cutter illustrated in FIG. 4.

A first embodiment of the cutter of the present invention may be seen by reference to FIGS. 4–6. By reference to the Figures, the cutter 20 is comprised of a disc shaped body 22 defining a peripheral cutting edge 25. Body 22 provides a bonding substrate for a superabrasive material forming a cutting face 24. In a preferred embodiment, body 22 is comprised of a cemented tungsten carbide, while the superabrasive material is comprised of a synthetic, polycrystalline diamond.

By reference to FIGS. 5 and 6, body 22 defines an interface 26 between the tungsten carbide and polycrystalline diamond layers which is characterized by an outer groove 30 formed in body 22 and defining at its outer extent said peripheral edge 25, which outer groove 30 bounding a series of inner, concentric grooves and ridges. In a preferred embodiment, outer groove may be between 0.020 and 0.050 inches in depth, as measured by the plane defined from the top of the substrate and along the longitudinal axis.

When viewed in cross section, concentric grooves 30, 32 and 34 are bounded by a series of concentric ridges 35, 37, and 39 formed in the tungsten carbide substrate. (See FIG. 5) Concentric grooves 30, 32 and 34 are intersected at regular intervals by a series of radial grooves 40, 42, and 44 formed through concentric ridges 35, 37, and 39 as illustrated. Radial grooves 40, 42, and 44 are preferably symmetrically oriented about cutting face 24 so as to provide optimum stress relief during both manufacture of the cutter 20 and use in the field.

Body 22 is adapted to accept the superabrasive layer bonded thereto in a conventional process in which a diamond powder is mixed with cobalt and the combination is pressed on cemented tungsten carbide substrate. The geometry of the irregular interface is such that the resulting abrasive layer is thicker, or possesses greater depth when viewed along the longitudinal axis, at concentric grooves 30, 32 and 34 than along concentric ridges 35, 37, and 39. (See FIG. 5) In such a fashion, difficulties associated with both stress relief and differential expansion coefficients are realized. In the same fashion, the thickness or depth of the superabrasive layer is also thicker at radial grooves 40, 42, and 44 than atop ridges 35, 37, and 39, though the thickness of this layer need not be the same as for grooves 30, 32, and 34 or even the same for each other.

In a preferred embodiment, the thickness of the superabrasive layer at each of concentric grooves 30, 32, and 34, when viewed along the longitudinal axis, is between 0.050 and 0.100 inches. The thickness of superabrasive layer at radial grooves 40, 42, and 44 is between 0.050 and 0.100 inches, though thickness of at least 0.25 inches are contemplated within the spirit of the invention for this and other embodiments. The thickness of the abrasive layer atop ridges 35, 37, and 39 is between 0.030 and 0.050 inches.

The preferred distance between the peripheral cutting edge 25 and the bottom 31 of outer groove 30 is between 0.010 and 0.100 inches. Although the aforedescribed dimensions are preferred, other dimensions are also contemplated within the spirit of the present invention.

Figure 7:
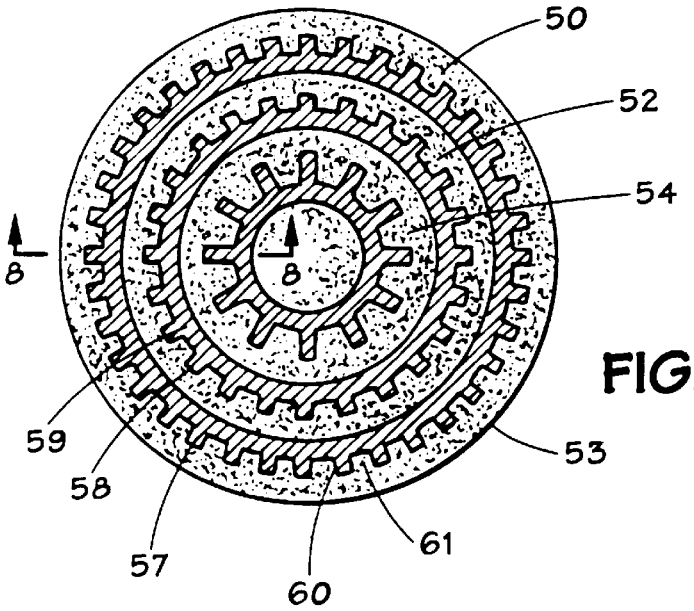
FIG. 7 is a top, cross-sectional view of a second embodiment of cutter of the present invention.
Figure 8:
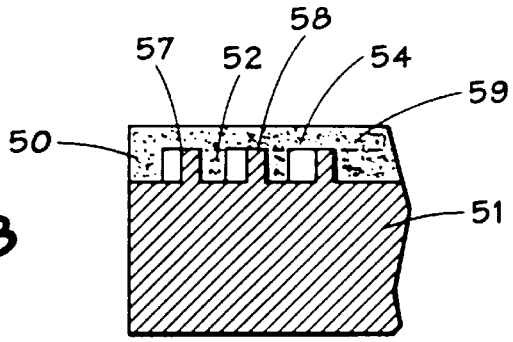
FIG. 8 is a side, cross-sectional view of the embodiment illustrated in FIG. 7.
Figure 9:
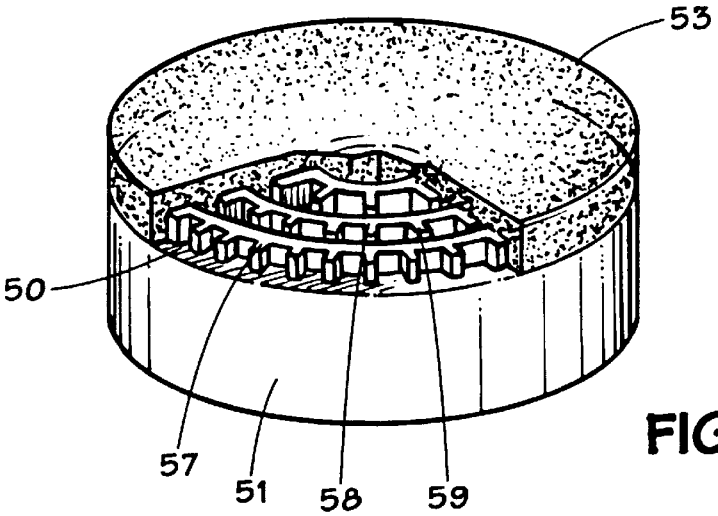
FIG. 9 is a perspective, cut-away view of the embodiment illustrated in FIG. 7.

A second embodiment of the present invention is illustrated at FIGS. 7–9. In this embodiment, a series of concentric grooves 50, 52 and 54 are concentrically disposed on the upper face of a disc shaped body 51, with the outer groove 50 disposed within the peripheral cutting edge 53 of body 51. In this embodiment, concentric grooves 50, 52 and 54 are bounded by a series of concentric ridges 57, 58, and 59, with the first or outermost such ridge 57 formed at the inner diametrical extent of outer groove 50. It is preferred that this embodiment include at least two but no more than five said grooves, three being illustrated. In conjunction with this embodiment, it is preferred that the thickness of the superabrasive layer of at least the outer groove 50 be between 0.050 and 0.100 inches, when taken along the longitudinal axis. It is also preferred that the superabrasive layer maintain a thickness of between 0.030 and 0.050 inches atop ridges 57, 58, and 59.

As illustrated, each ridge includes an elongate radial component, illustrated in FIG. 7 as 60, which components 60 are symmetrically aligned vis-a-vis other such components and also with respect to each ridge. As illustrated, each axial component preferably extends outwardly at least partially to the next outer ridge and defines a corresponding set of radial notches 61 in each bounding groove. (See FIG. 7) The radial length of each component 60 and corresponding notch 61 may vary. However, it is desired in conjunction with this embodiment, that said components 60 not extend to adjacent ridges. While this embodiment is illustrated as including a plurality of such radial elements 60 and corresponding notches 61. fewer or less such components may be used depending on the application. In conjunction with this embodiment, it is preferred that each concentric ridge include at least six but no more than thirty-six of said components 60. It is further contemplated that radial components 60 may be formed to the inner portion of each ridge.

In this embodiment, the outer diamond "ring" disposed in outer groove 50 must be sufficiently thin to allow the compressive effect of grooves 50, 52 and 54 to extend to the cutting face. In a preferred embodiment, the width of this outer diamond "ring", as measured radially from the cutting edge 53 to the adjacent ridge 57, is less than or equal to 0.050 inches.

Figure 10:
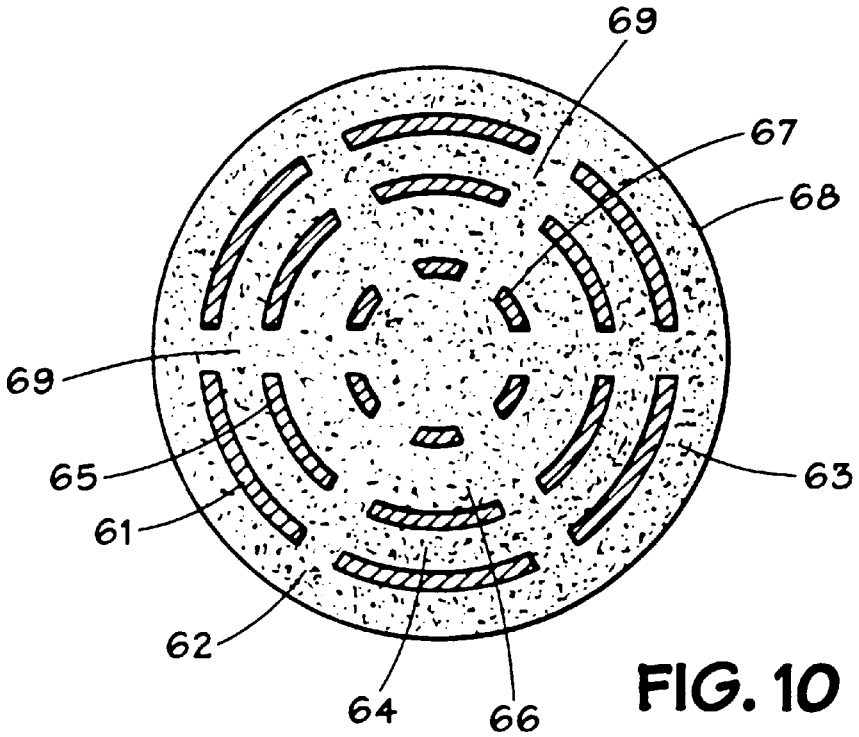
FIG. 10 is a top, cross-sectional view of a third embodiment of cutter of the present invention.
Figure 11:
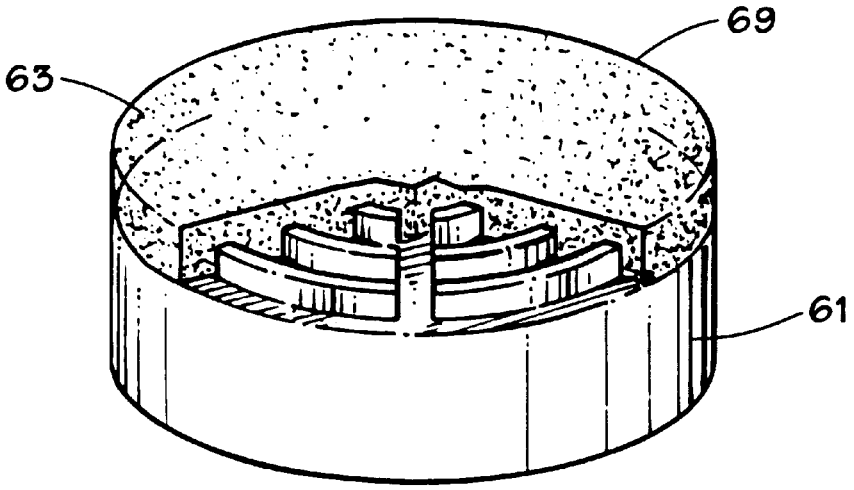
FIG. 11 is a perspective, cut-away view of the cutter illustrated in FIG. 10.

A third embodiment of the cutter of the invention is illustrated at FIGS. 10–11, and includes a disc shaped body 61 defining a plurality of concentric grooves 62, 64 and 66 bounded by radial ridges 61, 65, and 67. Body 61 may again be comprised of a cemented, tungsten carbide, and is adapted to receive a superabrasive material 63 such as a synthetic, polycrystalline diamond, to form a peripheral cutting edge 68.

In this embodiment, concentric grooves 62, 64 and 66 are intersected by a plurality of radially oriented grooves 69. In a preferred embodiment, grooves 69 run from the axis of the cutter to cutting edge 68, as illustrated. It is desired that grooves 69 be symmetrically distributed to form radial ridges of equal arc length and orientation vis-a-vis each other. In such a fashion, maximum stress relief may be realized. In this embodiment, the thickness of the polycrystalline layer at grooves 62, 64, and 66 may vary dependent on the radial distance from the longitudinal axis. In a similar fashion to that described above with respect to the embodiment of FIGS. 4–6, the thickness of polycrystalline diamond about grooves 62, 64, and 66 is preferably 0.050–0.100 inches, when received along the longitudinal axis. The thickness of polycrystalline diamond at ridges 61, 65, and 67 is preferably between 0.030 and 0.050 inches, although other thicknesses are also envisioned.

Figure 12:
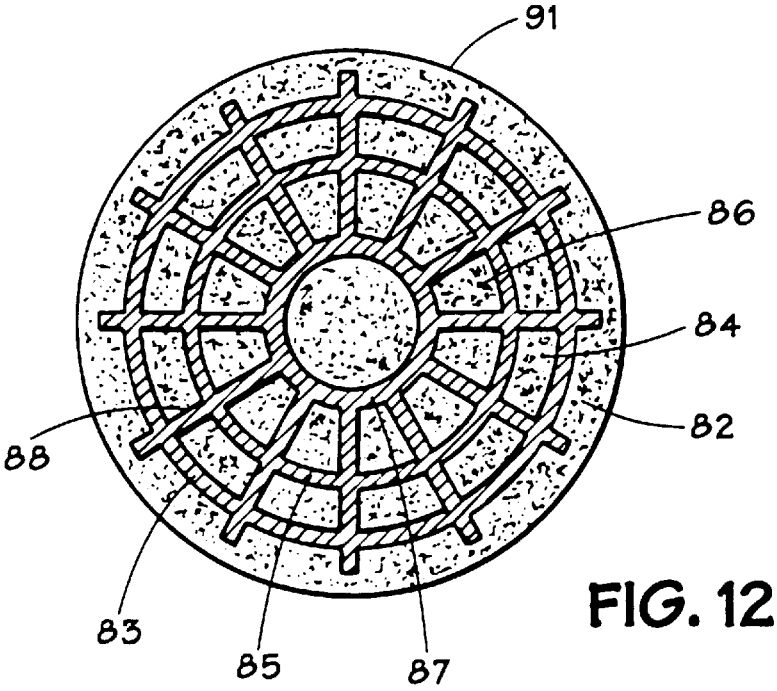
FIG. 12 is a top, cross-sectional view of a fourth embodiment of the cutter of the present invention.
Figure 13:
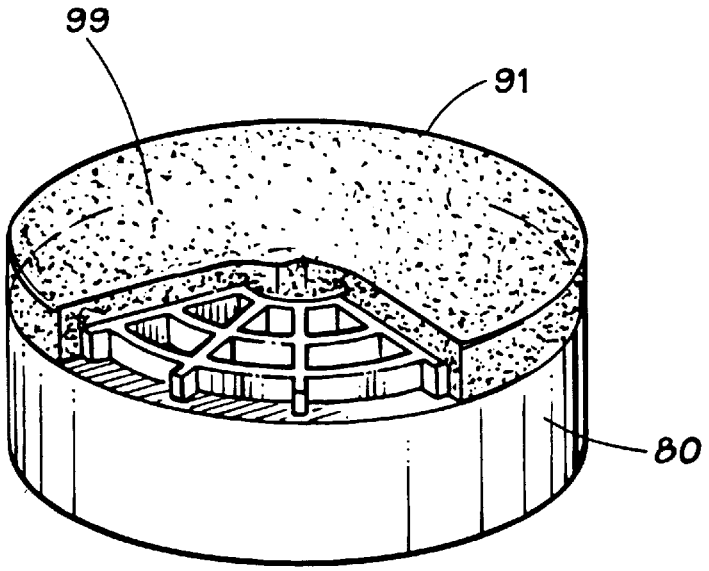
FIG. 13 is a perspective, cut-away view of the cutter illustrated in FIG. 12.

A fourth embodiment of the cutter of the invention is illustrated in FIGS. 12–13. In this embodiment, a disc shaped body 80 comprised of a hard metal, e.g. tungsten carbide, is provided about its face with a series of concentrically oriented grooves 82, 84 and 86, bounded by concentric ridges 83, 85, and 87. In this embodiment, outer ridge 83 is spaced a set distance from the peripheral cutting edge 91. Each of ridges 83, 85, and 87 are intersected by a series of radial segments 88 so as to join said ridges together in an integral structure, as illustrated. The combination structure is adapted to receive a superabrasive compound, e.g. synthetic polycrystalline diamond. As illustrated, segments 88 are preferably symmetrically disposed about cutting face 99 and extend slightly beyond outer ridge 83, but do not extend to cutting edge 91. In conjunction with this embodiment, it is contemplated that radial segments may vary in length dependent on the radial distance from said longitudinal axis.

In conjunction with this embodiment, it is preferred that the thickness of the superabrasive layer of at least the outer groove 82 be between 0.050 and 0.100 inches, when taken along the longitudinal axis. It is also preferred that the superabrasive layer maintain a thickness of between 0.030 and 0.050 inches atop ridges 83, 85, and 87.

Although particular detailed embodiments of the apparatus and method have been described herein, it should be understood that the invention is not restricted to the details of the preferred embodiment. Many changes in design, composition, configuration and dimensions are possible without departing from the spirit and scope of the instant invention.

What is claimed is:

1. A cutter including major front and back flat surfaces and a longitudinal axis where at least a portion of said front surface defines a cutter face, said cutter comprising:

a disc shaped body including said back surface, an opposing interface surface, and a periphery, where said interface surface includes a first outer groove defining said periphery and one or more inner concentric grooves bounded by a series of concentric ridges and by said first outer groove, where said outer and inner concentric grooves and ridges are interrupted by a series of ridges radially disposed about said interface; and a superabrasive material bonded to said body at said interface to create a uniform cutting surface on said front face such that said outer and inner grooves have a depth which defines a greater thickness of said superabrasive material, when viewed along the longitudinal axis.

2. The cutter of claim 1 where said body is comprised of a cemented tungsten carbide.

3. The cutter of claim 1 where said superabrasive material comprises synthetic diamond.

4. The cutter of claim 1 where said concentric ridges are comprised of a series of independent protrusions bounded by radial grooves where each said protrusion forming each concentric ridge is radially aligned with respect to corresponding protrusions on other said ridges.

5. The cutter of claim 1 where the thickness of said superabrasive material at each of the concentric grooves is between 0.050 and 0.100 inches, when measured along the longitudinal axis.

6. The cutter of claim 1 including at least one but no more than five concentric grooves.

7. The cutter of claim 1 where the thickness of the superabrasive material disposed in said first outer groove is equal to or greater than the thickness of superabrasive material disposed in any interior groove, as measured along the longitudinal axis.

8. The cutter of claim 1 where said concentric ridges are defined by a series of arcs symmetrically organized about the front surface with respect to each other.

9. The cutter of claim 1 where the depth of said outer groove, as measured from the front surface and along the longitudinal axis, is between 0.020–0.050 inches.

10. The cutter of claim 1 where the thickness of said superabrasive material at said concentric and radial ridges is between 0.030–0.050 inches, as measured along the longitudinal axis.

11. A cutter including major front and back flat surfaces and a longitudinal axis where at least a portion of said front surface defines a cutter face, said cutter comprising:

a disc shaped body including said back surface, an opposing interface surface, and a periphery, where said surface includes a first outer groove defining said periphery ridge and one or more inner concentric grooves bounded by an outer and a series of inner concentric ridges and said outer groove where said concentric ridges are at least partially joined by a series of radial ridges; and a superabrasive material bonded to said body at said interface to create a uniform cutting surface on said front face such that said first outer and one or more inner grooves define a greater thickness of said superabrasive material, when viewed along the longitudinal axis.

12. The cutter of claim 11 where said outer and inner grooves are interrupted by a series of grooves radially disposed about said interface.

13. The cutter of claim 11 where said concentric ridges are comprised of a plurality of axially oriented, radially distending protrusions.

14. The cutter of claim 13 where the protrusions are symmetrically spaced about the front surface.

15. The cutter of claim 13 including at least 6 but no more than 36 protrusions per concentric ridge.

16. The cutter of claim 13 where the length of said radial protrusions, when viewed radially, varies from groove to groove.

17. The cutter of claim 13 where said radially distending protrusions vary in length from ridge to ridge.

18. The cutter of claim 13 where said radially distending; protrusions are formed on all but the outer concentric ridge.

19. The cutter of claim 13 including at least 6 but no more than 36 radial protrusions per groove.

20. The cutter of claim 13 where said concentric grooves are joined together by a series of radial grooves.

21. The cutter of claim 20 where said radial grooves originate with the inner groove and radially extend to the first outer groove.

22. The cutter of claim 11 where said body is comprised of a cemented tungsten carbide.

23. The cutter of claim 11 where said superabrasive material comprises synthetic, polycrystalline diamond.

24. The cutter of claim 11 where the thickness of said superabrasive material at each of the concentric grooves is between 0.050 and 0.25 inches, when measured along the longitudinal axis.

25. The cutter of claim 11 where said concentric ridges are defined by a series of arcs symmetrically organized about the interface surface with respect to each other.

26. An abrasive tool insert comprising:

a substrate having an end face;

a continuous abrasive layer having a center, a periphery forming a cutting surface and a lower surface integrally formed on said end face of said substrate about a longitudinal axis and defining an interface therebetween, said lower surface of said abrasive layer defining a first outer circular protrusion and a series of inner concentric protrusions extending from said interface into the substrate said surface also defining a series of concentric ridges where said abrasive material is thinner about said ridges than about said protrusions;

said end face of said substrate defining a series of concentric grooves for receiving said concentric protrusions; and wherein said concentric ridges are at least partially linked by a series of radial ridges.

27. The abrasive tool insert of claim 26 where said substrate is comprised of cemented tungsten carbide.

28. The abrasive tool insert of claim 26 where said abrasive layer comprises polycrystalline diamond.

29. The abrasive tool insert of claim 26 where said concentric protrusions are joined together by said radial ridges.

30. The abrasive tool insert of claim 26 where said concentric protrusions are between 0.050 and 0.100 inches in thickness as measured along the longitudinal axis.

31. The abrasive insert of claim 26 where the concentric grooves define a series of arcs symmetrically aligned said longitudinal axis.

32. The abrasive tool insert of claim 26 where the concentric protrusions have a thickness which varies dependent on the radial distance of each protrusion from said longitudinal axis.

33. The abrasive tool insert of claim 26 where said radial ridges vary in length dependent on the radial distance from said longitudinal axis.

* * * * *

UNITED STATES PATENT AND TRADEMARK OFFICE

CERTIFICATE OF CORRECTION

PATENT NO. : 6,026,919

DATED : February 22, 2000

INVENTOR(S) : Thigpen et al.

It is certified that error appears in the above-identified patent and that said Letters Patent is hereby corrected as shown below:

On the title page item [57], line 5, please replace "redial" with - - radial - -.

line 7, please replace "like" with - - life - -.

column 5, line 65, please replace "88" with - - 97 - -.

claim 18, column 7, line 30, please delete ";".

Signed and Sealed this

Nineteenth Day of December, 2000

*Attest:*

Q. TODD DICKINSON

*Attesting Officer*

*Commissioner of Patents and Trademarks*